US006145423A

United States Patent [19]

Boreali et al.

[11] Patent Number: 6,145,423

[45] **Date of Patent: *Nov. 14, 2000**

[54] SEMI-AUTOMATIC DISPENSER FOR LINERLESS LABELS

[75] Inventors: Jeffrey J. Boreali, N. Tonawanda; Cas Formas, East Amherst; Steve Michalovic, Williamsville; Daniel G. Shenk, Niagara Falls, all of N.Y.

[73] Assignee: Moore Business Forms, Inc., Grand Island, N.Y.

[ * ] Notice: Under 35 U.S.C. 154(b), the term of this patent shall be extended for 563 days.

[21] Appl. No.: 08/529,230

[22] Filed: Sep. 15, 1995

[51] Int. Cl.[7] ..... B26D 5/28; B26D 7/06

[52] U.S. Cl. ..... 83/145; 83/168; 83/210; 83/349; 83/436.5; 83/436.7; 83/649; 156/353; 156/510; 221/71

[58] Field of Search ..... 83/349, 145, 649, 83/168, 436.3, 436.5, 436.55, 436.7, 210; 221/70, 71; 156/521, 522, 510, 353; 400/621, 613; 242/613

[56] References Cited

U.S. PATENT DOCUMENTS

| | | | |
|---|---|---|---|
| 3,587,376 | 6/1971 | Hirano et al. . | |
| 3,902,954 | 9/1975 | Lotto . | |
| 3,911,771 | 10/1975 | Schleifenbaum . | |
| 3,924,498 | 12/1975 | Hill . | |
| 4,149,484 | 4/1979 | Koch . | |
| 4,297,930 | 11/1981 | Putzke . | |
| 4,557,169 | 12/1985 | Kajiya et al. . | |
| 4,690,344 | 9/1987 | Yokota . | |
| 4,738,176 | 4/1988 | Cassia | 83/649 X |
| 4,817,483 | 4/1989 | Armbruster | 83/649 X |
| 4,823,663 | 4/1989 | Hamlin | 83/649 X |
| 4,892,019 | 1/1990 | Kogane et al. . | |
| 4,926,727 | 5/1990 | Maeda | 83/649 X |
| 4,972,743 | 11/1990 | Nojima . | |
| 5,042,351 | 8/1991 | Rosenthal | 83/649 |
| 5,134,915 | 8/1992 | Fukano et al. | 83/649 X |
| 5,375,494 | 12/1994 | Kajita et al. | 83/649 X |
| 5,375,752 | 12/1994 | Michalovic . | |
| 5,378,301 | 1/1995 | Boreali et al. . | |
| 5,417,783 | 5/1995 | Boreali et al. . | |
| 5,431,763 | 7/1995 | Bradshaw . | |
| 5,437,228 | 8/1995 | Uland . | |
| 5,447,383 | 9/1995 | Hirono et al. | 400/621 |

(List continued on next page.)

FOREIGN PATENT DOCUMENTS

| | | |
|---|---|---|
| 0370642 | 5/1990 | European Pat. Off. . |
| 0 577 241 A2 | 1/1994 | European Pat. Off. . |
| 1428189 | 1/1966 | France . |
| 4314927 | 11/1994 | Germany . |
| 2170178 | 7/1986 | United Kingdom . |
| WO 95/22445 | 8/1995 | WIPO . |

*Primary Examiner*—M. Rachuba
*Assistant Examiner*—Charles Goodman
*Attorney, Agent, or Firm*—Nixon & Vanderhye P.C.

[57] ABSTRACT

A semi-automatic linerless label dispenser effectively dispenses labels from a support for a supply of continuous form linerless labels, each label having a pressure sensitive adhesive face and an adhesive-release material face. First and second grooved drive rolls engage the labels and first and second sets of stripper and guiding fingers disposed in at least some of the grooves of the drive rolls guide the labels and prevent them from sticking to the drive rolls. At least the first drive roll and the first set of stripper fingers have adhesive-release material portions (e.g. plasma coatings) which engage the adhesive face of labels from the supply. An automatic cutter mounted on the opposite side of the stripper and guiding fingers from the support includes pivotally movable and stationary blades, and a silicone-impregnated felt wiper. A housing contains the components and includes an exit opening with spring fingers for biasing a label adhesive face into contact with the adhesive-release material coated wall as a label is being cut by the cutter mechanism, and holding the label after cutting until positively removed from the housing. Semi-automatic operation is provided by utilizing various electric drives and sensors including label position, cutter movement, and label take away sensors.

20 Claims, 5 Drawing Sheets

U.S. PATENT DOCUMENTS 5,478,161 12/1995 Suzuki et al. ..... 400/621 X
5,524,996 6/1996 Carpenter et al. ..... 400/621
5,531,853 7/1996 Cubow et al. ..... 156/521
5,556,213 9/1996 Kudo et al. ..... 400/621
5,560,293 10/1996 Boreali et al. ..... 400/621
5,605,404 2/1997 Nunokawa et al. ..... 400/208
5,647,261 7/1997 Wierenga ..... 83/649
5,725,719 3/1998 Szczepaniec et al. ..... 156/353

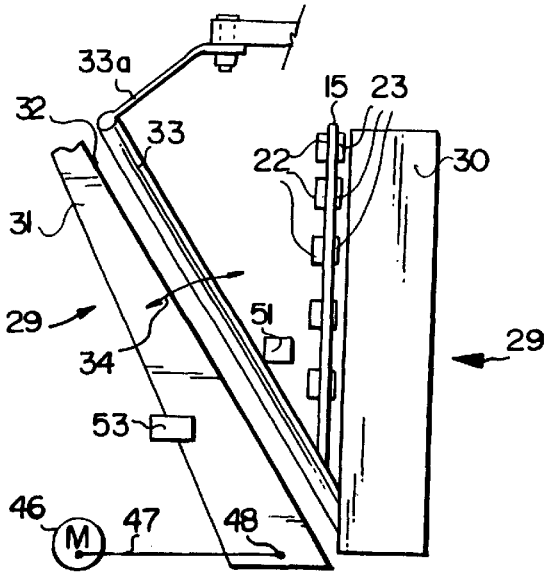
FIG. 3
FIG. 4
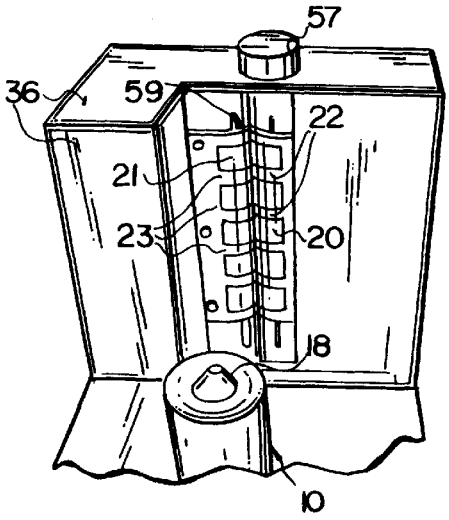
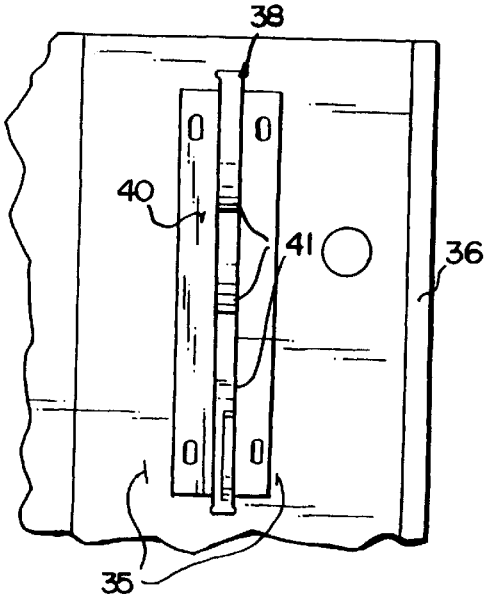
FIG. 8

SEMI-AUTOMATIC DISPENSER FOR LINERLESS LABELS

BACKGROUND AND SUMMARY OF THE INVENTION

The use of linerless labels is becoming widespread due to relatively low cost of such labels and due to their relative environmental friendliness. A number of different dispensers has been developed—such as shown in U.S. Pat. Nos. 5,375,752 and 5,417,783, European published application 0577241, and U.S. application Ser. No. 08/312,068 filed Sep. 26, 1994 now abandoned—to facilitate dispensing of such labels. Each of those dispenser is particularly suited for certain dispensing requirements and can successfully dispense linerless labels without prohibitive difficulties. However, there are some circumstances for which such dispensers are not ideally suited, and therefore the linerless label dispenser according to the present invention—and its associated cutting mechanism—have been developed.

The linerless label dispenser, and its associated cutting mechanism, according to the present invention are ideally suited for dispensing fineness labels from a roll. The dispenser according to the present invention has few operating components and dispenses the linerless labels in a simple yet effective manner. The dispenser of the invention effects automatic cutting of the labels from a continuous supply (such as a roll), therefore the labels need not be provided with perforations, although cutting may take place along perforation lines.

According to one aspect of the present invention a linerless label dispenser is provided comprising the following components: A support for a supply of continuous form linerless labels, each label having a pressure sensitive adhesive face and an adhesive-release material face. First and second grooved drive rolls for engaging the labels and taking them off the supply, and first and second sets of stripper and guiding fingers disposed in at least some of the grooves of the first and second drive rolls, respectively, and at least the first drive roll and the first set of stripper fingers having adhesive-release material portions which engage the adhesive face of labels from the supply. An automatic cutter mounted on the opposite side of the stripper and guiding fingers from the support. And a housing containing the drive rolls and fingers, and cutter, and having an inlet adjacent the support for the supply of labels, and an exit opening on the opposite side of the cutter from the drive rolls. It will be appreciated that the purpose of the stripper fingers is not only to guide the linerless labels but also to strip the labels from any contact with the rolls. Thus, as the label passes through the rolls, there may be a tendency for one or the other or both sides of the label to adhere to the rolls, notwithstanding the existence of adhesive release material portions on at least one of the rolls. Hence, the fingers guide and strip the label from any tendency to adhere to the rolls.

The exit preferably includes biasing means for biasing a label adhesive face into contact with an adhesive-release material coated wall as a label is being cut by the cutter mechanism, and holding the label after cutting until positively removed from the housing. The biasing means preferably comprise a plurality of spring fingers engaging the release material face of the label.

The adhesive-release material of the first drive roll, first set of stripper and guiding fingers, and exit wall preferably comprise a plasma coating, such as disclosed in U.S. Pat. No. 5,375,752, the disclosure of which is hereby incorporated by reference herein. However, there are other adhesive-release materials, such as polytetrafluoroethylene and silicone coatings, may be utilized.

Semi-automatic operation is provided by utilizing various electric drives and sensors. Preferably the automatic cutter and drive roll each include electric drives, and sensors include a label position sensor, a cutter movement sensor, and a label take away sensor, all connected to a control mechanism such as a computer control. The connections of the electric drives and the sensors are such that, under the control of the computer control, when the label position sensor senses a particular portion of a label (such as a demarcation mark) from the supply, the drive rolls drive is stopped, and the cutter drive is actuated to effect cutting of a label from the supply. Operation of the drive rolls to feed another label from the supply is precluded until the take away sensor senses removal of the cut label from the housing. The cutter movement sensor senses movement of the cutter and allows only one cutter movement until the drive rolls are again actuated.

The automatic cutter preferably comprises a stationary anvil blade and a pivoting movable blade and an electric drive for pivoting the movable blade about a pivot axis in a path of movement into operative association with the stationary blade to effect scissors-action cutting of a label thereby. The movable blade initially comes into contact with the adhesive face of the label being cut, and the cutter preferably further comprises a silicone impregnated felt element mounted adjacent the path of movement of the movable blade which is engaged by the movable blade so as to have silicone applied thereto, to minimize build up of adhesive on the movable blade. Alternatively or in addition the movable blade (and the stationary blade if desired) may be plasma coated.

Typically the housing includes a door on which the exit is disposed, allowing access to the cutter, and there is an electrical interlock between the door and the electric drive for the movable blade to preclude operation of the electric drive of the blade if the door is not fully closed. The drive rolls are preferably rotatable about substantially vertical parallel axes and the movable blade is pivotable about a substantially horizontal axis, and the support for the supply of labels comprises a substantially vertically extending shaft, and the exit opening comprises a substantially vertical slit.

The first and second stripper and guiding fingers may comprise two to eight fingers in each set, disposed at a regular frequency along the drive rolls, with each finger having a width of about 0.5 inches, but typically within the range of 0.1–2.5 inches. Normally a finger is provided at locations on a label from the supply spaced between about 15–30% of the width of the label. Where particularly aggressive adhesive is provided on the label a finger is utilized about every 15% along the width of the label. Where the adhesive is repositional adhesive, having much lower aggressiveness, a finger need only be provided about every 30% along the width of a label.

According to another aspect of the present invention a semi-automatic linerless dispenser is provided comprising the following components: A support for a supply of continuous form linerless labels, each label having a pressure sensitive adhesive face and an adhesive-release material face. First and second drive rolls for engaging the labels and taking them off the supply, and at least the first drive roll having adhesive-release material portions which engage the adhesive face of labels from the supply, the stripper fingers having entrance portions angled relative to one another to facilitate entry of the labels between the rolls. An automatic cutter mounted on the opposite side of the drive rolls from the support. A housing containing the drive rolls and cutter, and having an inlet adjacent the support for the supply of labels, and an exit opening on the opposite side of the cutter from the drive rolls. And the exit opening is defined by a wall coated with adhesive-release material, and includes biasing means for biasing a label adhesive face into contact with the adhesive-release material coated wall as a label is being cut by the cutter mechanism, and holding the label after cutting until positively removed from the housing. The details of the control mechanism, automatic cutter, and the like are preferably as described above.

According to yet another aspect of the present invention a linerless label dispenser is provided comprising the following components: A support for a supply of continuous form linerless labels, each label having a pressure sensitive adhesive face and an adhesive-release material face. First and second drive rolls for engaging the labels and taking them off the supply, and at least the first drive roll having adhesive-release material portions which engage the adhesive face of labels from the supply. An automatic cutter mounted on the opposite side of the stripper and guiding fingers from the support, the automatic cutter comprising a stationary anvil blade and a pivoting movable blade and an electric drive for pivoting the movable blade about a pivot axis in a path of movement into operative association with the stationary blade to effect cutting of a label thereby. And a housing containing the drive rolls, and cutter, and having an inlet adjacent the support for the supply of labels, and an exit opening on the opposite side of the cutter from the drive rolls. Again the details of the automatic cutter, housing exit, etc., are preferably as described above.

It is the primary object of the present invention to provide a simple yet effective semi-automatic linerless label dispenser, with automatic cutting capability. This and other objects of the invention will become clear from an inspection of the detailed description of the invention and from the appended claims.

BRIEF DESCRIPTION OF THE DRAWINGS

FIG. 3 is a schematic end view primarily showing an exemplary cutting mechanism according to the present invention;

FIG. 4 is an inlet end more detailed view of the exemplary dispenser according to the present invention;

FIG. 8 is an exit end view of the housing of the dispenser of FIGS. 2 through 7.

DETAILED DESCRIPTION OF THE DRAWINGS

Figure 1:
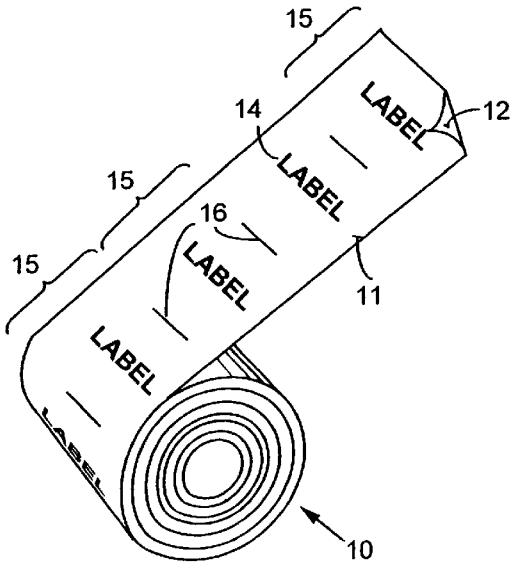
FIG. 1 is a top perspective view of a roll of linerless labels dispensed according to the present invention.

FIG. 1 illustrates an exemplary continuous supply (e.g. roll) 10 of linerless labels that are dispensed according to the invention. The labels have an adhesive-release material (e.g. silicone) coated face 11, and a pressure sensitive adhesive coated face 12 on opposite faces of a substrate 13 (see FIG. 2) such as paper. Indicia 14 is printed on the same face as the coating 11, either underneath or on top of the coating 11. While perforation lines may be provided between individual labels 15, since cutting is provided according to the invention perforation lines are not necessary, but rather sensing lines or other marks need only be provided, such as the marks 16 schematically illustrated in FIG. 1. While the lines 16 may be on the adhesive material 11 face of the labels 15, they may also be on or underneath the adhesive of the adhesive face 12.

Figure 2:
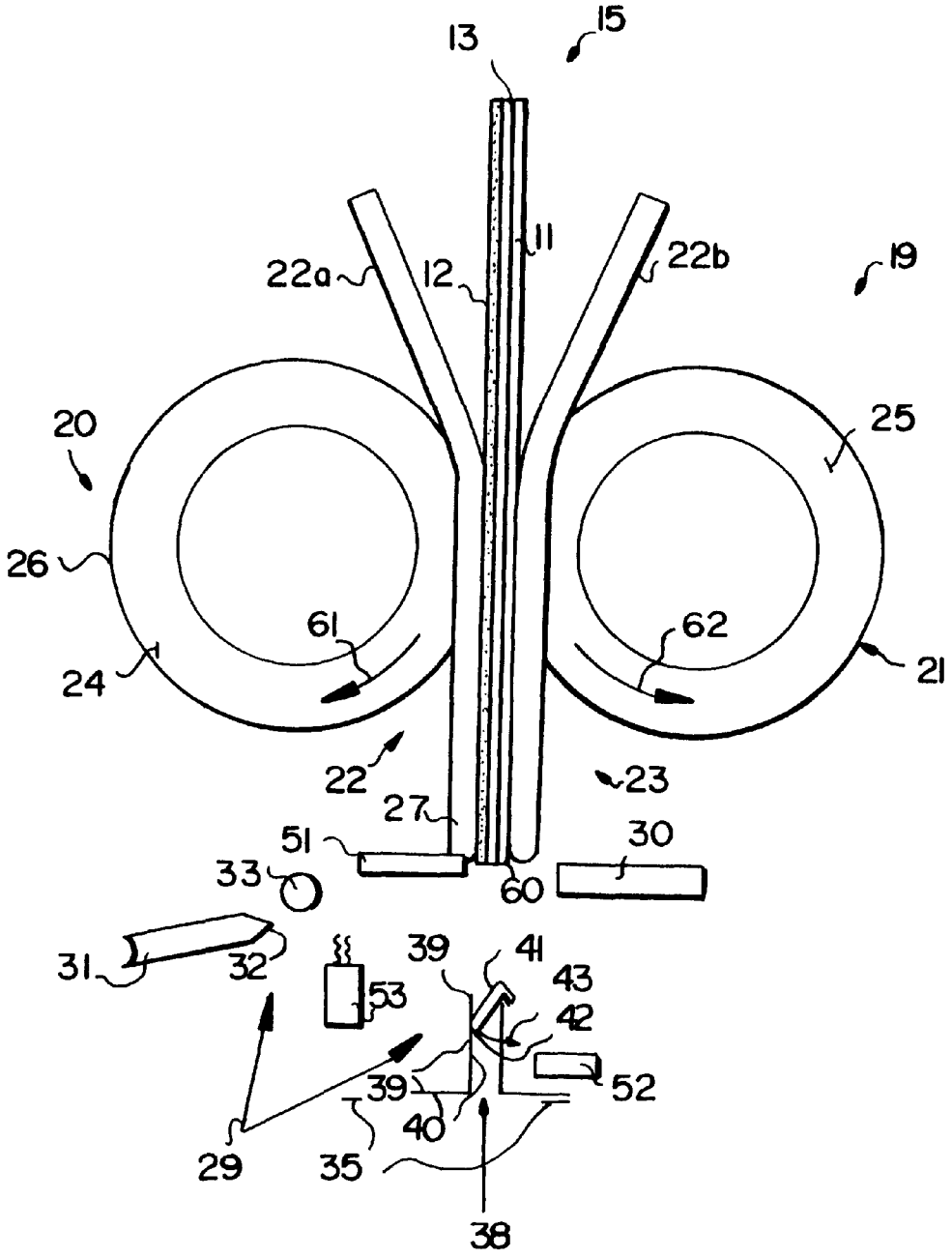
FIG. 2 is a schematic top view illustrating the basic components of the dispenser according to the present invention.
Figure 5:
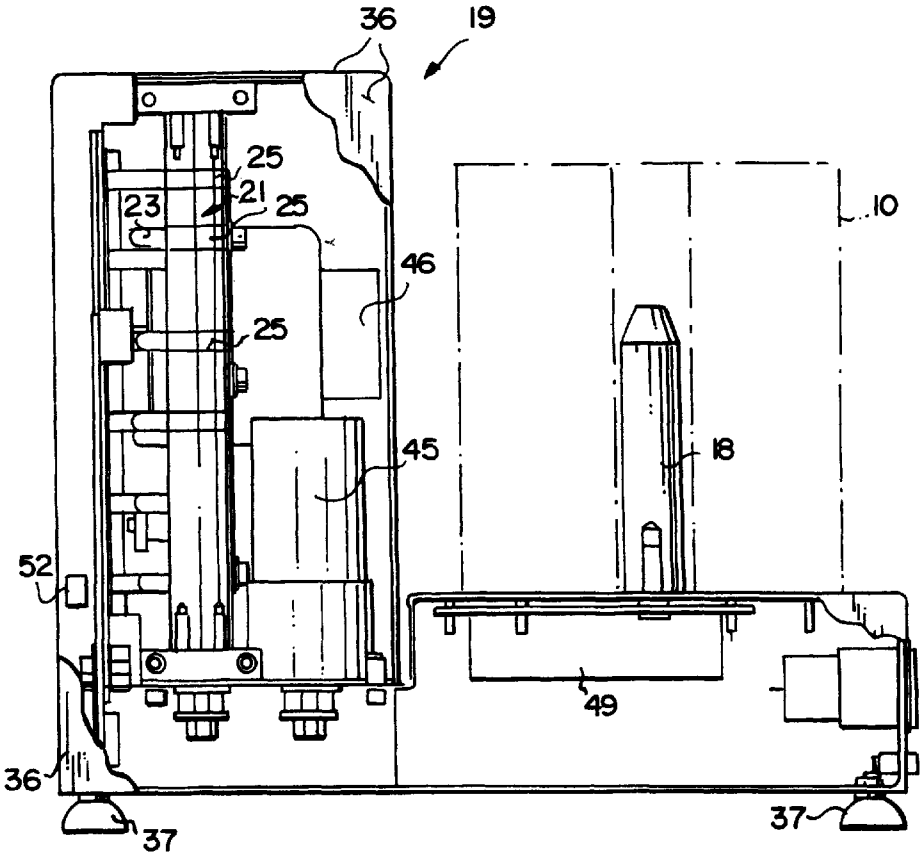
FIG. 5 is a side elevational view of the dispenser of FIG. 4, with portions of the housing cut away.
Figure 7:
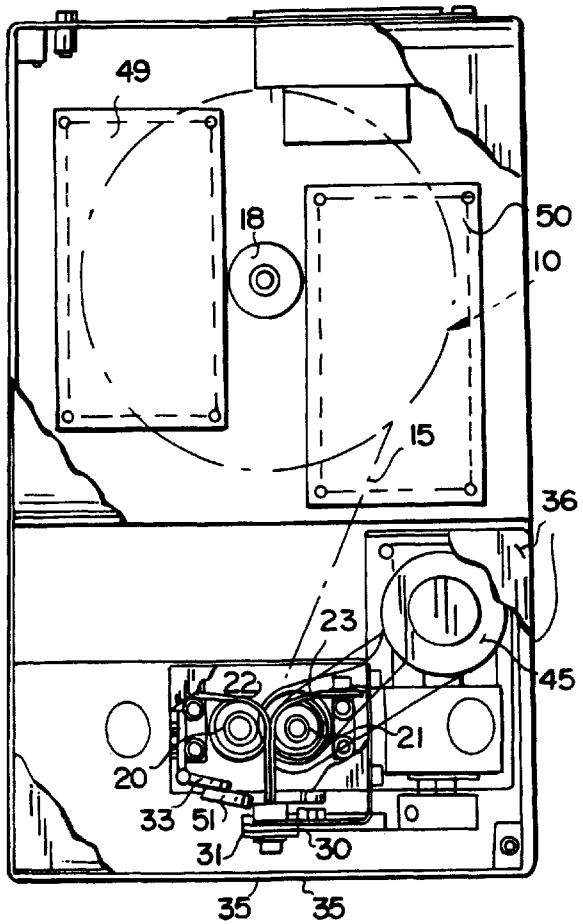
FIG. 7 is a top view of the dispenser of FIGS. 2 through 6 with the housing cut away.

FIG. 2 schematically illustrates the basic components of the linerless label dispenser according to the invention except for a support for a supply of continuous form linerless labels 10, such a support being illustrated in the form of a substantially vertical shaft 18 in FIGS. 4, 5, and 7. While a vertical shaft 18 is illustrated, any suitable support that allows the roll 10 to be taken off for dispensing of the labels may be provided. As illustrated in FIGS. 4 and 5, a housing need not be provided covering the roll 10, although one may optionally be provided.

The linerless label dispenser according to the present invention is illustrated schematically generally by reference 19 in FIG. 2, and includes first and second grooved drive rolls 20, 21 for engaging labels 15 from the support 10. The rolls 20, 21 are rotatable about substantially parallel, preferably substantially vertical, axes. Also, first and second sets of stripper and guiding fingers 22, 23, respectively, are provided disposed in at least some of the grooves (e.g. see grooves 24 and 25 for the rolls 20, 21, respectively, in FIG. 2) of the rolls 20, 21. The fingers 22, 23 have entrance portions 22*a*, 22*b* angled relative to one another, e.g., 45°, to facilitate entry of the leading edges of the labels 15 to the nip of rolls 20, 21. The entrance portions 22*a*, 22*b* may have an angle as great as 180° but preferably the angle is considerably less to enable smooth guided entry of the labels into the nip of the rolls. At least the roll 20 on the first set of fingers 22 have adhesive-release material portions which engage the adhesive face 12 of the labels 15 from the supply 10. For example, a coating 26 of adhesive-release material may be provided on the circumference of the roll 20, and a similar coating 27 on the exterior portions of the fingers 22. While a wide variety of adhesive-release coatings may be utilized, such as a polytetrafluoroethylene, silicone based materials, and the like, it is preferred that the roll 20 and the fingers 22 be of metal and that the coatings 26, 27 be plasma coatings such as disclosed in U.S. Pat. No. 5,375,752 (the disclosure of which is hereby incorporated by reference herein).

If non-stick polytetrafluoroethylene coatings are used (particularly for housing components as hereafter described) they may be Teflon® coatings such as provided by Empire Coatings of Albion, N.Y. For the rollers 20, 21 non-stick features may be provided by Silicon Rubber Hirel, 2601, such as available from Silicon Products of Lancaster, N.Y. While it is not essential for all circumstances that the roll 21 and the fingers 23 have adhesive-release material coatings, such coatings are preferred on elements 21, 23 too even though in most situations they will only engage the release material face 11 of the labels 15 from the supply 10.

On the opposite side of the rollers 20, 21 from the support 18 and supply 10 is an automatic cutter, shown schematically at 29 in FIGS. 2 and 3. The automatic cutter 29 preferably comprises a stationary anvil blade 30, in the preferred embodiment in the drawings being shown mounted adjacent the termination of the fingers 23, that is on the adhesive-release material face 11 side of the labels 15. The anvil 30 cooperates with a pivoted movable cutter blade 31, so that a scissors cutting action is provided. The movable blade 31 includes a cutting edge 32 thereof which cooperates with the anvil 30 to do the actual cutting. Both of the blades 31, 30 are preferably of hardened steel, and while a plasma coating may be provided therefor (particularly for the cutting edge 32 which will initially come into contact with the adhesive face 12 of the labels 15 during the scissors cutting action), instead of or in addition to such a coating, a silicone-impregnated felt element, such as the felt wiper illustrated schematically at 33 in FIGS. 2 and 3, is positioned adjacent the path of movement (illustrated schematically by arrow 34 in FIG. 3) of the movable blade 31 to minimize build-up of adhesive on the movable blade 31, particularly the edge 32 thereof. While the silicone-impregnated felt element 33 preferably is stationary with respect to the path of movement 34 of the movable blade 31, it may be rotatable about an axis, such as shown for a similar wiper in EPO published application 0 577 241 and supported adjacent one end by a spring 33*a* secured to a fixed support.

The dispenser 19 also includes a housing, only the exit defining portions 35 of which are seen in FIG. 2, but other portions 36 of which are seen in the more detailed drawings of FIGS. 4 through 8. The housing 35, 36 may be mounted on the feet 37 (see FIGS. 5 and 6) for ready positioning on a table or other surface. The exit at the portions 35 of the housing preferably comprises a substantially vertical elongated channel or slit-like opening shown schematically at 38 in FIGS. 2 and 8. One wall 39 defining the channel 38 preferably has a coating 40 of adhesive-release material, again preferably a plasma coating on the metal of the wall 39. The wall 39 is what is adapted to engage the adhesive face 12 of the labels 15 as they are dispensed. In order to hold the labels 15 in place during and after cutting it is preferred that a biasing means be provided for biasing a label 15 adhesive face 12 into contact with the material 40. Such biasing means may comprise a wide variety of structures, including inherently resilient materials such as foam, coil spring pressed elements, gravity weighted elements, or the like, but preferably comprise a plurality of spring (e.g. spring steel or other metal, or plastic having recovery properties) fingers 41, as schematically illustrated in FIGS. 2 and 8. The fingers 41 typically will have the free ends 42 thereof cammed away—as illustrated by the arrow 43 in FIG. 2—by the release coated face 11 of a label 15 as it is driven by the drive rolls 20, 21 into position to be cut by the automatic cutter 29. The natural resiliency of the material of the fingers 41 presses in the direction against the arrow 43 to hold the label 15 adhesive face 12 against the coating 40, typically until an operator actually manually grasps a cut label 15 and removes it from the channel 38 by pulling outwardly. Preferably at least three fingers 41 are provided, as illustrated in FIG. 8, substantially uniformly spaced along the height of the channel or slot 38.

The invention also includes various electrical components for providing semi-automatic control of the dispenser 19 to insure positive, effective, and simple operation. In a preferred embodiment, the rollers 20, 21 are driven by an electrical drive, such as the motor 45 illustrated in FIGS. 5, 7, and 9. The motor 45 may drive both rolls 20, 21, or may drive only one roll, the frictional engagement of the label 15 between the rolls 20, 21 effecting driving of the other roll. The automatic cutter 29 is also driven by an electric drive, such as the electric motor 46 illustrated in FIGS. 3, 5, 6, and 9. The motor 46 is preferably connected by a linkage, such as the linkage 47 schematically illustrated in FIG. 3 and illustrated in more detail in FIG. 6, which transforms rotary motion of the motor 46 into pivotal movement of the blade 31 about the substantially horizontal pivot axis illustrated schematically at 48 in FIGS. 3 and 6.

Figure 9:
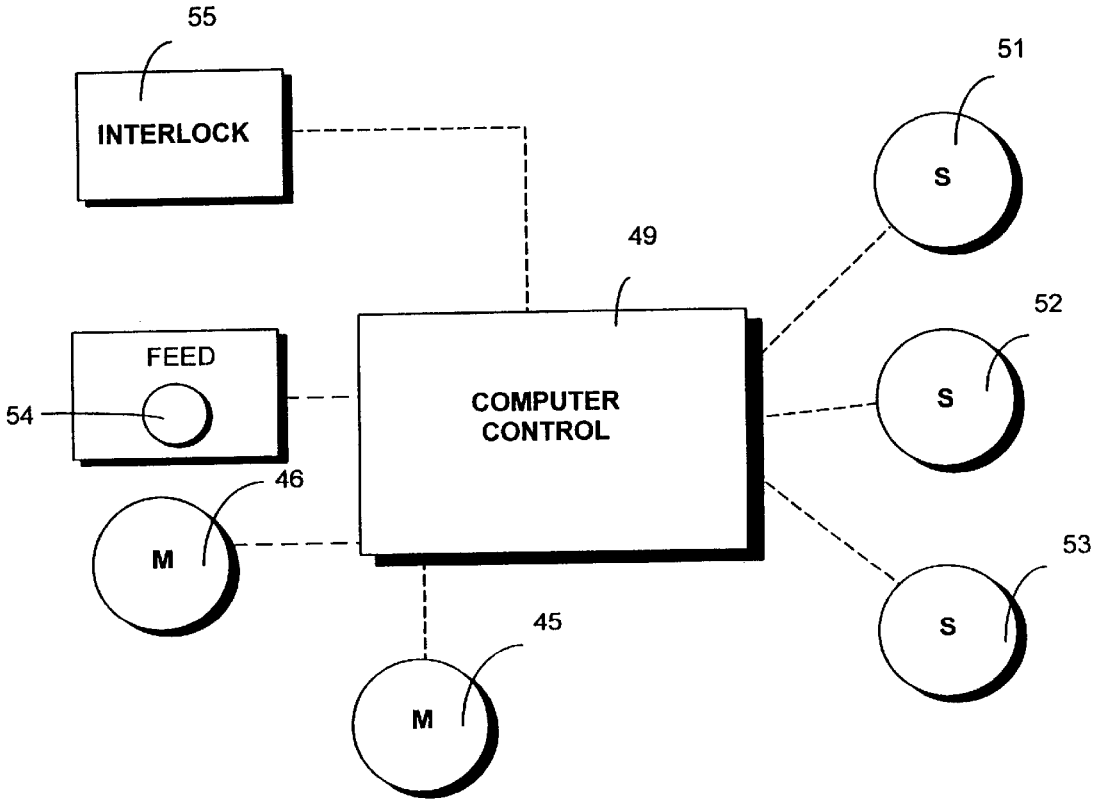
FIG. 9 is a control schematic showing the electrical and control interconnections between the components of the dispenser.

The motors 45, 46 are connected up to a control mechanism 49, such as the computer control illustrated schematically in FIGS. 7 and 9, which may be powered by a suitable power source 50 which may comprise a battery or a connection to an AC or DC electrical cord.

Cooperating with the motors 45, 46 and computer control 49 to control operation of the components are a plurality of sensors, preferably optical sensors. In the preferred embodiment illustrated in the drawings three such sensors are provided, a label feed sensor 51 (see FIGS. 2, 3, 6, 7 and 9), for sensing a mark (such as a mark 16) on a label 15; a take away sensor 52 (see FIGS. 2, 5, and 9) for sensing when a cut label 15 has been removed from the channel/slot 38; and a cutter movement sensor shown schematically at 53 in FIGS. 2, 3, 6, and 9, which senses movement of the movable blade 31 of the automatic cutter 29. The sensors 51 through 53 are operatively connected to the computer control 49 as schematically illustrated in FIG. 9.

Various other electrical components are also preferably provided such as the feed push button 54 (see FIGS. 6 and 9) which initiates operation of the motor 45, and the electrical interlock 55 (see FIG. 9). Preferably the housing portions 35, defining the exit slot 38, are part of a door which either can be pivoted away from, or simply removed from (by detachment of spring connectors, by removal of screw fasteners or in any other suitable conventional manner) from the rest of the housing 36. The interlock 55—which may be of any conventional construction—senses when the door containing the housing portions 35 is less than fully closed, and if not fully closed will not allow operation of the cutter motor 46, so that if an operator has gained access to the interior of the housing 36 containing the cutter 29, rolls 20, 21, etc., the safety hazard of the movable cutter blade 31 will not confront the operator.

Various other components may also be provided for the dispenser 19. For example, there are gear, belt, or like connections between the motor 45 and one or both of the rolls 20, 21, which are conventional and are not shown, as well as various other sensors or safety elements if necessary or desirable. Also, a manual advance knob 57 (see FIGS. 4 and 6) may be provided connected to the drive roller 20 for initially rotating the roller 20 to properly position the first label 15 from the roll 10 at the start of a new roll 10.

Exemplary apparatus of the dispenser 19 having been described, the typical operation thereof will now be set forth.

Operation

A roll 10 of linerless labels 15 is placed on the substantially vertical shaft 18, and the lead label from the roll is moved into the inlet 59 (see FIGS. 2 and 4) of the housing 36 so that the adhesive face 12 thereof is in contact with the roll 20 and stripping guiding fingers 22 plasma coated surfaces, while the release coat face 11 thereof is in contact with the roll 21 and the fingers 23. The manual knob 57 is rotated to drive the roller 20 until the leading edge 60 (see FIG. 2) of the leading label 15 of the roll 10 is approximately at a point in alignment with the anvil blade 30. Then with the door portions 35 of the housing 36 closed, the operator presses the feed button 54. This initiates operation of the electric motor 45 which drives one or both of the rollers 20, 21 in the direction of the arrows 61, 62 illustrated in FIG. 2, so that the label 15 cams the leading edges 42 of the spring fingers 41 out of the way and the leading edge of the leading label 15 passes through the exit slot 38.

Operation of the motor 45 continues until the sensor 51 senses a mark 16 or perforation indicating the end of the leading label 15. This optical sensing by the sensor 51—through the computer control 49—immediately stops operation of the motor 45. With the leading label 15 then held in place by its connection to the next label (between the fingers 22, 23) and by the spring fingers 41 biasing it against the plasma coated portion 40 of the exit wall 39, the computer control 49 actuates the motor 46.

Figure 6:
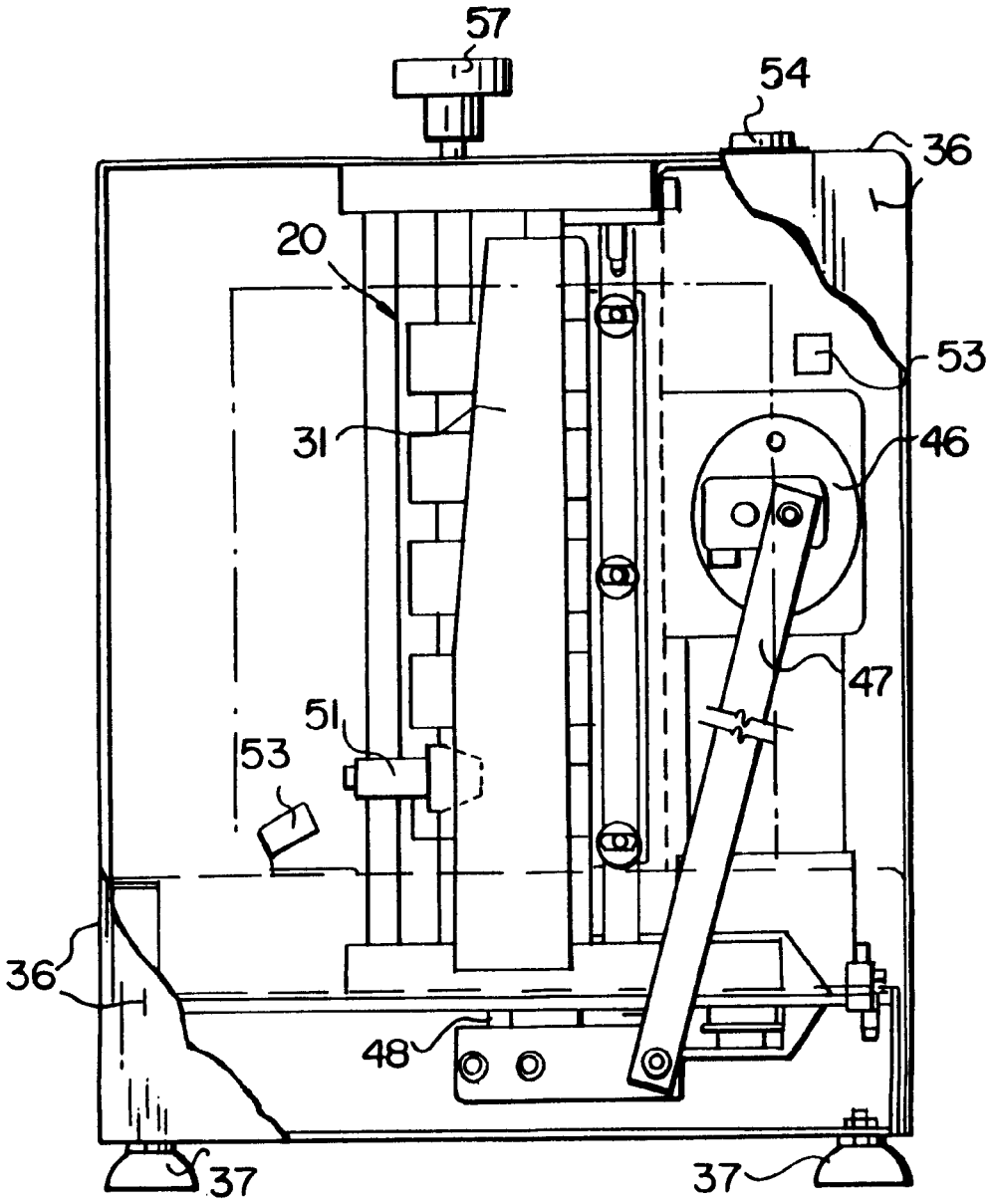
FIG. 6 is an exit end view, with the housing cut away, of the dispenser of FIGS. 2 through 6.

The motor 46, through the linkage 47, pivots the movable cutting blade 31 from the position schematically illustrated in FIGS. 2 and 3 to the position illustrated in FIG. 6, moving in the path 34 into operative association with the anvil blade 30 so that a scissors cutting action of the leading label 15 from the next label of the roll 10 takes place. The movement of the cutter blade 31 is sensed by the optical sensor 53, which through the computer control 49 then terminates operation of the motor 46 after one revolution of the motor 46, in which the movable blade 31 is returned to its initial position as seen in FIGS. 2 and 3.

The leading label 15, which has then been cut from the roll 10, does not fall out of the dispenser 19 since it is held in place by the spring fingers 41 biasing the adhesive face 12 thereof into contact the plasma coating 40. Operation of the motor 45 is blocked until the take away sensor 52 senses removal of the cut label 15. Once the operator grasps the cut label 15 and pulls it out of the slot 38, the take away sensor 52 senses this, and through the computer control 49 allows the motor 45 to be operated again when the operator pushes the feed button 54. Alternatively, the feed button 54 may be bypassed or done away with, and as soon as the sensor 52 senses removal of the cut label 15 (or after a short delay), the motor 45 may be automatically actuated by the computer control 49 to advance the next label 15 from the roll 10.

As the blade 31 moves in its path 34, at least the edge 32 thereof moves up against the silicone impregnated felt element 33, receiving a thin coating of silicone, which prevents build up of the adhesive from the adhesive face 12 of the label 15 as the edge 32 moves into contact therewith.

It will thus be seen that according to the present invention a simple yet effective semi-automatic dispenser is provided for linerless labels. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A linerless label and dispenser combination, comprising:

a support, a supply of continuous form linerless labels carried by said support, each said label having a pressure sensitive adhesive face and an adhesive-release material face;

first and second grooved drive rolls for engaging said labels and taking said labels off said supply, and first and second sets of stripper and guiding fingers disposed in at least some of the grooves of said first and second drive rolls, respectively, and at least said first drive roll and said first set of stripper fingers having adhesive-release material portions which engage the adhesive face of labels from said supply, said first and second sets of stripper fingers having entrance portions angled relative to one another to facilitate entry of the labels between the rolls;

an automatic cutter mounted on an opposite side of said stripper and guiding fingers from said support; and a housing containing said drive rolls and fingers, and cutter, and having an inlet adjacent said support for said supply of labels, and an exit opening on an opposite side of said cutter from said drive rolls.

2. A combination as recited in claim 1 wherein said exit opening is defined by a wall coated with adhesive-release material, and includes biasing means for biasing the adhesive face of one of the labels into contact with said adhesive-release material coated wall as the one label is being cut by said automatic cutter, and holding the cut label after cutting until positively removed from said housing.

3. A combination as recited in claim 2 wherein said biasing means comprise a plurality of spring fingers engaging the release material face of the label.

4. A combination as recited in claim 2 wherein said adhesive-release material portions of said first drive roll and said first set of stripper and guiding fingers, and said adhesive-release material of said wall comprises a plasma coating.

5. A combination as recited in claim 2 wherein said automatic cutter and said drive rolls each include electric drives; and further comprising a label position sensor, a label takeaway sensor, and a control mechanism, said sensors and said electric drives connected to said control mechanism so that when said label position sensor senses a particular portion of a label from said supply said drive rolls drive is stopped and said cutter drive is actuated to effect cutting of a label from said supply, and operation of said drive rolls to feed another label from said supply is precluded until said takeaway sensor senses removal of the cut label from said housing.

6. A combination as recited in claim 5 further comprising a cutter movement sensor connected to said control mechanism so that said cutter movement sensor senses movement of said cutter and allows only one cutter movement until said drive rolls are again actuated.

7. A combination as recited in claim 1 wherein said automatic cutter comprises a stationary anvil blade and a pivoting movable blade and an electric drive for pivoting said movable blade about a pivot axis in a path of movement into operative association with said stationary blade to cut one of the labels from the label supply.

8. A combination as recited in claim 7 wherein said movable blade initially comes into contact with the adhesive face of the one label being cut; and a silicone-impregnated felt element stationarily mounted adjacent the path of movement of said movable blade to engage the same movable blade to minimize build-up of adhesive on said movable blade.

9. A combination as recited in claim 7 wherein said housing includes a door, in which said exit is disposed, allowing access to said cutter; and further comprising an electrical interlock between said door and said electric drive for said movable blade to preclude operation of said electric drive for said movable blade if said door is not fully closed.

10. A combination as recited in claim 7 wherein said drive rolls are rotatable about substantially vertical parallel axes, and said movable blade is pivotal about a substantially horizontal axis, said support for said supply of labels comprises a substantially vertically extending shaft, and said exit comprises a substantially vertical channel.

11. A combination as recited in claim 1 wherein said first and second sets of stripper and guiding fingers comprise 2–8 fingers in each set, disposed at a regular frequency along said drive rolls, each finger having a width of between 0.1–2.5 inches.

12. A combination as recited in claim 11 wherein said width of at least one of said fingers is between about 15–30% of a width of one of said labels.

13. A combination as recited in claim 1 wherein said automatic cutter and said drive rolls each include electric drives; and further comprising a label position sensor, and a control mechanism, said sensor and said electric drives connected to said control mechanism so that when said label position sensor senses a particular portion of a label from said supply said drive rolls drive is stopped and said cutter drive is actuated to effect cutting of a label from said supply.

14. A combination as recited in claim 13 further comprising a cutter movement sensor connected to said control mechanism so that said cutter movement sensor senses movement of said cutter and allows only one cutter movement until said drive rolls are again actuated.

15. A combination as recited in claim 14 further comprising a label takeaway sensor connected to said control mechanism so that operation of said drive rolls to feed another label from said supply is precluded until said takeaway sensor senses removal of the cut label from said housing.

16. A semi-automatic linerless label dispenser comprising:

a support for a supply of continuous form linerless labels, each label having a pressure sensitive adhesive face and an adhesive-release material face;

first and second drive rolls for engaging said labels and taking them off said supply, and at least said first drive roll having adhesive-release material portions which engage the adhesive face of labels from said supply;

an automatic cutter mounted on an opposite side of said drive rolls from said support;

a housing containing said drive rolls and cutter, and -having an inlet adjacent said support for said supply of labels, and an exit opening on an opposite side of said cutter from said drive rolls; and said exit opening is defined by a wall coated with adhesive-release material, and includes biasing means for biasing the adhesive face of one of the labels into contact with said adhesive-release material coated wall as a label is being cut by said cutter mechanism, and holding the label after cutting until positively removed from said housing.

17. A dispenser as recited in claim 16 wherein said automatic cutter and said drive rolls each include electric drives; and further comprising a label position sensor, a label takeaway sensor, and a control mechanism, said sensors and said electric drives connected to said control mechanism so that when said label position sensor senses a particular portion of a label from said supply said drive rolls drive is stopped and said cutter drive is actuated to effect cutting of a label from said supply, and operation of said drive rolls to feed another label from said supply is precluded until said takeaway sensor senses removal of the cut label from said housing.

18. A combination as recited in claim 17 further comprising a cutter movement sensor connected to said control mechanism so that said cutter movement sensor senses movement of said cutter and allows only one cutter movement until said drive rolls are again actuated.

19. A linerless label dispenser, comprising:

a support for a supply of continuous form linerless labels, each label having a pressure sensitive adhesive face and an adhesive-release material face;

first and second drive rolls for engaging said labels and taking them off said supply, and at least said first drive roll having adhesive-release material portions which engage the adhesive face of labels from said supply;

an automatic cutter mounted on an opposite side of said drive rolls from said support, said automatic cutter comprising a stationary anvil blade and a pivoting movable blade and an electric drive for pivoting said movable blade about a pivot axis in a path of movement into operative association with said stationary blade to effect cutting of a label thereby; and a housing containing said drive rolls, and cutter, and having an inlet adjacent said support for said supply of labels, and an exit opening on an opposite side of said cutter from said drive rolls.

20. A dispenser as recited in claim 19 wherein said movable blade initially comes into contact with the adhesive face of a label being cut, and further comprising a silicone-impregnated felt element mounted adjacent the path of movement of said movable blade to minimize build-up of adhesive on said movable blade; and wherein said drive rolls have an electric drive; and further comprising a label position sensor, and a control mechanism, said sensor and said electric drives connected to said control mechanism so that when said label position sensor senses a particular portion of a label from said supply, said drive rolls drive is stopped and said cutter drive is actuated to effect cutting of a label from said supply, and a cutter movement sensor connected to said control mechanism so that said cutter movement sensor senses movement of said cutter and allows only one cutter movement until said drive rolls are again actuated.

* * * * *